US012599955B1

(12) United States Patent
Ramirez

(10) Patent No.: US 12,599,955 B1
(45) Date of Patent: Apr. 14, 2026

(54) DEVICES AND METHODS FOR FORMING RIVET JOINTS

(71) Applicant: Atieva, Inc., Newark, CA (US)

(72) Inventor: Hector Ramirez, Newark, CA (US)

(73) Assignee: Atieva, Inc., Newark, CA (US)

( * ) Notice: Subject to any disclaimer, the term of this patent is extended or adjusted under 35 U.S.C. 154(b) by 0 days.

(21) Appl. No.: 18/955,538

(22) Filed: Nov. 21, 2024

(51) Int. Cl.
*B21J 15/04* (2006.01)

(52) U.S. Cl.
CPC ..... *B21J 15/04* (2013.01)

(58) Field of Classification Search
CPC ..... B21J 15/04
See application file for complete search history.

(56) References Cited

U.S. PATENT DOCUMENTS

2013/0205574 A1* 8/2013 Doo ..... B21J 15/10 29/524.1
2016/0332214 A1* 11/2016 Hornbostel ..... B21J 15/025
2017/0165739 A1* 6/2017 Wang ..... B29C 66/81431

* cited by examiner

*Primary Examiner* — Kyle A Cook
(74) *Attorney, Agent, or Firm* — Womble Bond Dickinson (US) LLP

(57) ABSTRACT

A method of inserting a fastener into a workpiece includes positioning the workpiece with at least two sheets of material between a die and a head of a fastening system. The workpiece has a first fastening site, a second fastening site, and a third fastening site. The second fastening site is between the first fastening site and the third fastening site. A passage of the head is aligned with the second fastening site. A bottommost surface of the head in contact with the workpiece from the first fastening site to the third fastening site. The method also includes inserting the fastener into the workpiece through the passage of the head at the second fastening site and through the sheets of material. The method also includes upsetting an end of a shank of the fastener with the die to fasten the sheets of material together.

13 Claims, 6 Drawing Sheets

DEVICES AND METHODS FOR FORMING RIVET JOINTS

BACKGROUND

1. Technical Field

The present disclosure relates to fastening system and, more specifically, to devices and methods for creating riveted joints in a workpiece without deformation of the workpiece.

2. Discussion of Related Art

Riveting has been a fundamental joining technique in many manufacturing industries such as the automobile industry since the early 20th century. Initially, rivets were primarily used in the assembly of vehicle chassis and frames, providing a strong and durable connection between metal components. As automobiles evolved, the demand for lightweight and efficient vehicles led to the development of advanced riveting techniques, including self-piercing rivets. These were particularly beneficial for joining dissimilar materials, such as aluminum and steel, which became more common as manufacturers sought to improve fuel efficiency and reduce emissions. Riveting offered a reliable alternative to welding, which can be problematic with certain materials due to thermal distortion or metallurgical incompatibility. Riveting technology has continued to evolve, with modern automated riveting systems being employed to enhance production speed and consistency.

Despite its advances, riveting continues to face several challenges, one of which is the issue of "pillowing." Pillowing occurs when the material around the rivet deforms, creating a bulge or "pillow" effect. Depending on the location of the rivet on a vehicle, pillowing can result in various issues ranging from reduced aesthetic appeal to compromised aerodynamics. This deformation is often a result of improper rivet selection, incorrect riveting force, or unsuitable material combinations. Additionally, the integration of new materials like carbon fiber composites presents further challenges for traditional riveting methods without causing damage to these advanced materials.

SUMMARY

Accordingly, there is a need for devices and methods for creating rivet joints that minimize or prevent pillowing deformations. This disclosure relates generally to a head for fastening systems that create rivet joints without causing pillowing of the workpiece.

In an aspect of the present disclosure, a method of inserting a fastener into a workpiece including at least two sheets of material includes positioning the workpiece with the at least two sheets of material between a die and a head of a fastening system. The workpiece has a first fastening site, a second fastening site, and a third fastening site. The second fastening site is between the first fastening site and the third fastening site. A passage of the head is aligned with the second fastening site of the workpiece. A bottommost surface of the head in contact with the workpiece from the first fastening site to the third fastening site. The method also includes inserting the fastener into the workpiece through the passage of the head at the second fastening site and through the at least two sheets of material. The method also includes upsetting an end of a shank of the fastener with the die to fasten the at least two sheets of material together.

In aspects, the method includes repositioning the workpiece between the die and the head with the third fastening site aligned with the passage of the head. The bottommost surface may be in contact with the workpiece from the second fastening site to a fourth fastening site. The third fastening site may be position between the second fastening site and the fourth fastening site. Repositioning the workpiece may include automatically aligning the passage of the third fastening site.

In some aspects, positioning the workpiece with the bottommost surface in contact with the workpiece at the first fastening site and the third fastening site is configured to prevent pillowing of the workpiece between the first fastening site and the second fastening site and between the second fastening site and the third fastening site when the end of the shank of the fastener is upset with the die. Positioning the workpiece may include advancing the head toward the die to clamp the workpiece between the die and the head such that the bottommost surface is in contact with the workpiece.

In certain aspects, inserting the fastener and upsetting the end of the shank of the fastener occur concurrently. Inserting the fastener into the workpiece may include striking the fastener with a punch of the fastening system.

In another aspect of the present discloser, a method for forming a rivet joint to form a body panel of an automobile includes positioning a flange of the body panel between a die and a head of the fastening system. The flange has a first fastening site, a second fastening site, and a third fastening site. The second fastening site is between the first fastening site and the third fastening site. A passage of the head is aligned with the second fastening site of the flange. A bottommost surface of the head is in contact with the flange from the first fastening site to the third fastening site. The method also includes inserting a rivet through the passage of the head at the second fastening site. The method also includes upsetting an end of a shank of the rivet with the die.

In aspects, the method includes repositioning the flange between the die and the head with the third fastening site aligned with the passage of the head. The bottommost surface may be in contact with the flange from the second fastening site to a fourth fastening site. The third fastening site may be positioned between the second fastening site and the fourth fastening site.

In some aspects, positioning the flange with the bottommost surface in contact with the flange at the first fastening site and the third fastening site is configured to prevent pillowing of the flange between the first fastening site and the second fastening site and between the second fastening site and the third fastening site when the end of the shank of the rivet is upset with the die. Positioning the flange may include advancing the head toward the die to clamp the flange between the die and the head such that the bottommost surface is in contact with the flange. Positioning the flange may include uniformly contacting the bottommost surface with the flange between the first fastening site and the third fastening site.

In another aspect of the present disclosure, a head for a fastening system includes a connector and a nose. The connector has a topmost surface of the head. The nose extends from the connector in a direction away from the topmost surface. The nose terminates in a bottommost surface of the head opposite the topmost surface. A drive axis of the head extends through the head orthogonal to the topmost surface and the bottommost surface. The head defines a passage extending therethrough about the drive axis of the head. The nose includes the bottommost surface, a first end portion, a second end portion opposite the first end portion, a front side, and a back side opposite the front side. The front side extends between the first end portion and the second end portion. The back side includes a first wing segment, a second wing segment, and a central segment between the first wing segment and the second wing segment. The first wing segment extends from the central segment to the first end portion such that the nose has a central thickness between the front side and the back side at the central segment and a first end thickness between the front side and the back side at the first end portion. The second wing segment extends from the central segment to the second end portion such that the nose has a second end thickness between the front side and the back side at the second end portion.

In aspects, the first wing segment extends from the central segment to the first end portion at a first wing angle with respect to the central segment such that the central thickness of the nose is greater than the first end thickness and the second wing segment extends from the central segment to the second end portion at a second wing angle with respect to the central segment such that the central thickness of the nose is greater than the second end thickness.

In some aspects, the bottommost surface has a substantially trapezoidal profile. The first wing segment and the second wing segment may have an equal length. The first wing angle and the second wing angle may be a range of 5 degrees to 80 degrees. The first wing angle and the second wing angle may be equal. The head at the bottommost surface may have a length between the first end portion and the second end portion in a range of 40 mm to 80 mm.

In certain aspects, the nose supports the bottommost surface such that the bottommost surface is rigid. The nose may have a substantially trapezoidal profile.

In particular aspects, a fastening system includes a fastener setting tool configured to insert a fastener into a workpiece and a head connected to the fastener setting tool such that the fastener passes through the passage of the head when inserted into the workpiece. The nose of the head may be configured to prevent deformation between multiple fastening sites when the fastener is deformed within the workpiece. The nose of the head has a length between the first end portion and the second end portion at the bottommost surface such that the bottommost surface is configured to contact multiple fastening sites when the fastener is inserted into the workpiece. The length of the nose at the bottommost surface is determined by the equation $L=2(s(d))$, where L is the length of the nose at the bottommost surface, s is a number in a range of two to six, and d is a diameter of the fastener.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein.

DETAILED DESCRIPTION

Figure 1:
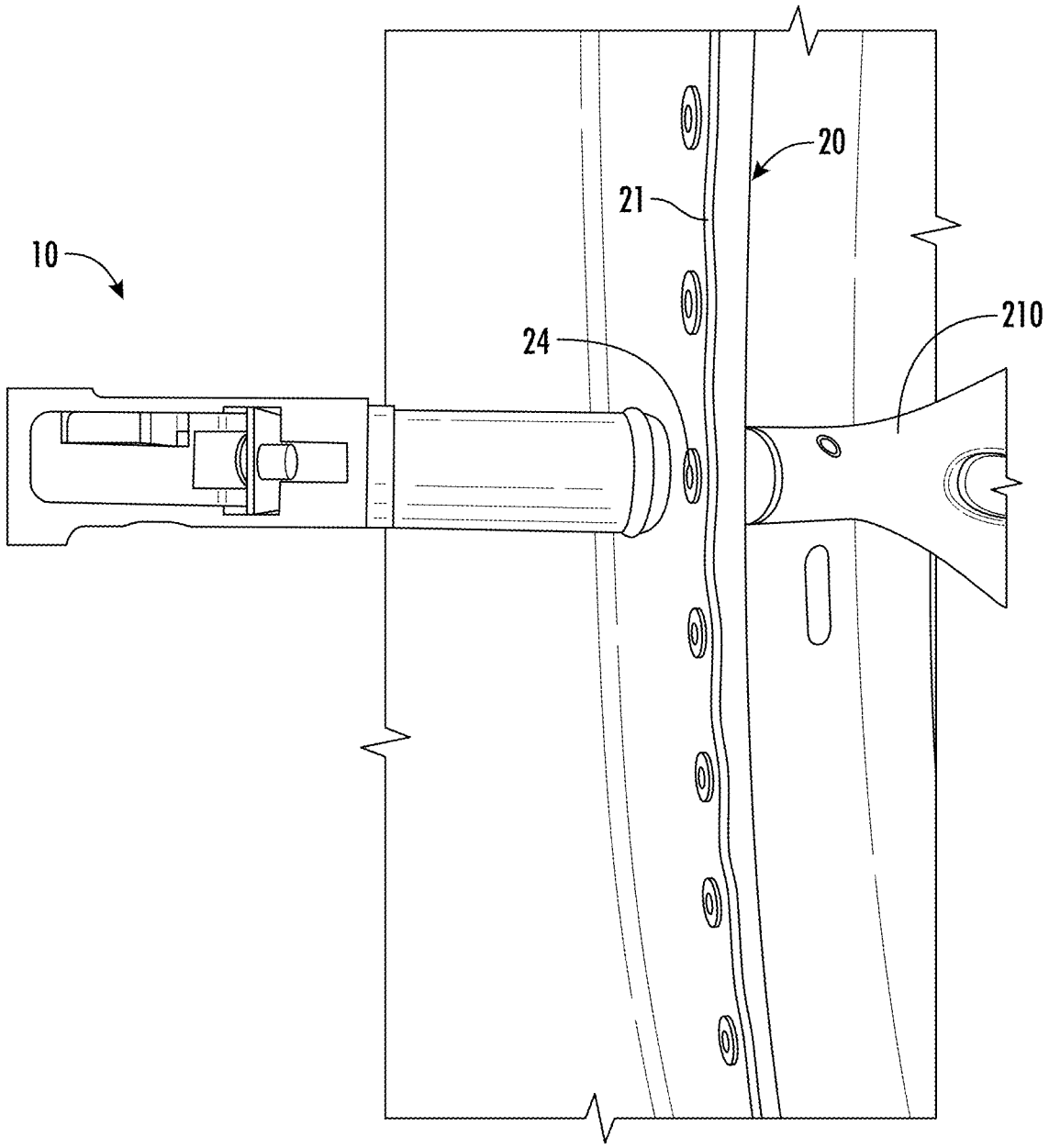
FIG. 1 (PRIOR ART)
FIG. 1 is a close-up perspective view of a fastening system with a conventional head with a workpiece positioned between a die of the fastening system and the conventional head.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

Pillowing in riveted joints is a phenomenon that occurs when the material around the rivet deforms, creating a raised or "pillowed" appearance. This is often a concern in aerospace, automobile, and other industries where riveted joints are commonly used. Pillowing of a rivet joint may be caused by a variety of factors such as differences in the material properties of the rivet and the surrounding material, improper installation techniques, e.g., inadequate setting pressure, or uneven load distribution across the rivet joint. Consequences of pillowing may include increased stress concentrations around the rivet, potentially leading to premature failure, aesthetic issues, functional problems such as physical interference with moving components, or compromise of any sealants or gaskets used around or between the rivet joints. Accordingly, there is a need for devices and methods of forming riveted joints that resist pillowing.

For example, as shown in FIG. 1, use of a conventional head 10 and die 210 for riveting may produce pillowing in the workpiece 20. The conventional head 10 has a round head that is smaller than the heads described hereinbelow. Specifically, the conventional head 10 only contacts the workpiece 20 at a single fastening site. As such, the forces applied to the workpiece 20 when a fastener 24, e.g., a rivet, is inserted into the workpiece 20 and set by the die 210 are not distributed and the workpiece 20 may be deformed. Accordingly, a joint 21 of the workpiece 20 may be pillowed as shown. The pillowed joint 21 may increase the likelihood of corrosion of the workpiece 20 at the joint 21. In some embodiments, the pillowed joint 21 may interfere with other elements of an assembly. For example, where the pillowed joint 21 is located along a doorjamb of an automobile body, the pillowed joint 21 may interfere with opening and closing of a door of the automobile.

Described herein are devices and methods for forming rivet joints that resist, reduce, or eliminate pillowing. Specifically, heads for use with conventional riveting systems that minimize or prevent pillowing of a riveted joint. The heads detailed herein may distribute riveting forces across a greater surface area than conventional heads for riveting. The heads detailed herein are configured to contact the workpiece at multiple fastening sites. Contacting the workpiece at multiple fastening sites may resist the deformation of the material between the adjacent fasteners. Resisting the deformation of the material between adjacent fasteners may minimize or prevent pillowing.

Figure 2:
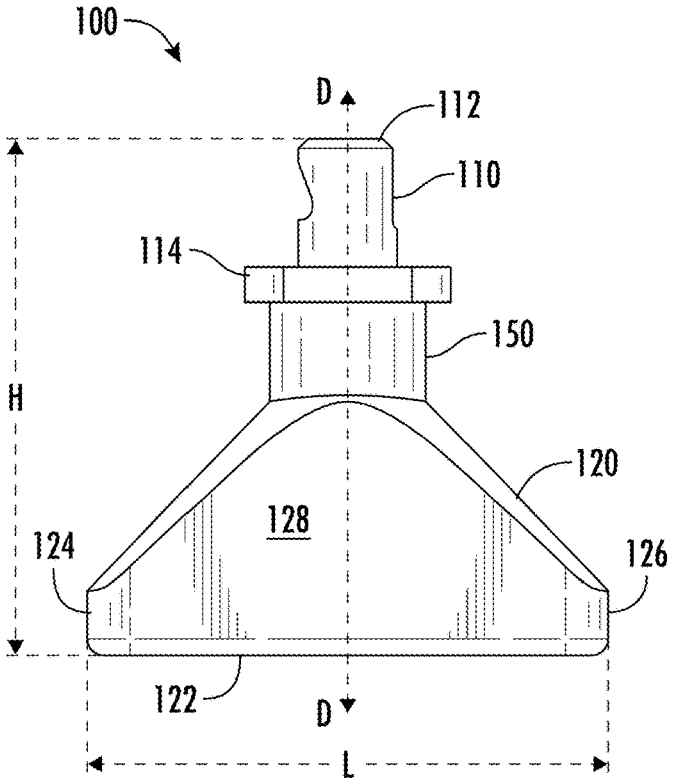
FIG. 2 is a front view of a head for a fastening system in accordance with embodiments of the present disclosure.
Figure 3:
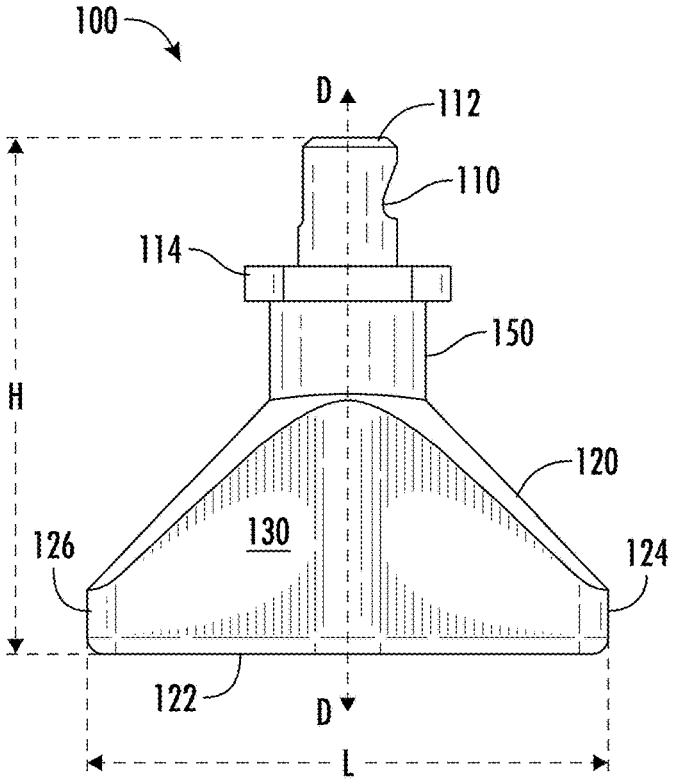
FIG. 3 is a rear view of the head of FIG. 2.
Figure 4:
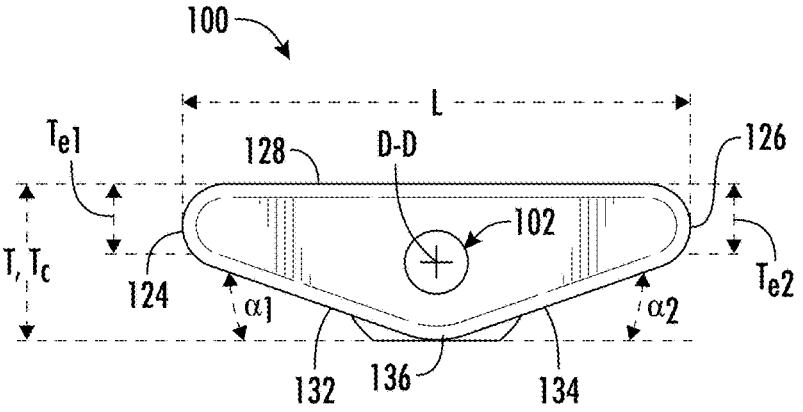
FIG. 4 is a bottom view of the head of FIG. 2.

Referring now to FIGS. 2-4, a head 100 for a fastening system, e.g., a riveting system 200 (FIG. 5), is described in accordance with embodiments of the present disclosure. The head 100 includes a connector 110 and a nose 120. The connector 110 is configured to couple the head 100 to the fastening system. The nose 120 is configured to minimize or prevent deformation of a workpiece when a fastener is formed to join the workpiece at a fastening site.

The connector 110 is configured to couple the head 100 to the fastening system. The connector 110 may be any conventional connection for connecting a conventional head to the fastening system. For example, the connector 110 may be a machine taper connection. The connector 110 includes a topmost surface 112 of the head 100. As shown, the topmost surface 112 is planar. In embodiments, the topmost surface 112 may be non-planar, e.g., hemispherical. The connector 110 may include a rim 114. The rim 114 may engage the fastening system to resist rotation of the head 100 and maintain the orientation of the nose 120 with respect to the fastening system.

The nose 120 includes a bottommost surface 122 of the head 100, a first end portion 124, a second end portion 126, a front side 128, and a back side 130. A height H of the head 100 is the distance between the bottommost surface 122 and the topmost surface 112. A length L of the head 100 is the distance between extremities of the first end portion 124 and the second end portion 126. A thickness T of the head 100 is the distance between the front side 128 and the back side 130.

The head 100 defines a drive axis D-D that extends through the connector 110 and the nose 120. The drive axis D-D may be orthogonal to the topmost surface 112 or the bottommost surface 122. The head 100 defines a passage 102 that extends therethrough about the drive axis D-D. The passage 102 may extend through the topmost surface 112 and/or the bottommost surface 122. The passage 102 may be located centrally along the length L of the head 100. More particularly, the center of the passage 102 at the bottommost surface 122 may be equidistant from the first end portion 124 and the second end portion 126. The bottommost surface 122 may be planar as shown in FIGS. 1 and 2. The bottommost surface 122 may be parallel to the topmost surface 112.

The nose 120 extends from the connector 110 in a direction away from the topmost surface 112 and terminates in the bottommost surface 122. The nose 120 supports the bottommost surface 122 such that the bottommost surface 122 is rigid and does not deflect when a fastener is inserted into the workpiece through the passage 102. Specifically, the size and dimension of the nose 120 may assist in distributing forces across the entirety of the bottommost surface 122. For example, as shown in FIGS. 1 and 2, the nose 120, when viewed from the front or rear, may have a generally trapezoidal profile. The generally trapezoidal profile of the nose 120 may prevent deflection of the bottommost surface 122 to maintain the planar nature the of bottommost surface 122 when a fastener is inserted into the workpiece 220.

With particular reference to FIG. 4, the front side 128 extends between the first end portion 124 and the second end portion 126. The front side 128 may be planar as shown. In some embodiments, the front side 128 may be arcuate. The back side 130 includes a first wing segment 132, a second wing segment 134, and a central segment 136. The first wing segment 132 extends from the central segment 136 to the first end portion 124. The first wing segment 132 extends to the first end portion 124 at a first wing angle $\alpha_1$ with respect to the central segment 136. The second wing segment 134 extends from the central segment 136 to the second end portion 126. The second wing segment 134 extends from the central segment 136 at a second wing angle $\alpha_2$ with respect to the central segment 136. The first wing angle $\alpha_1$ and the second wing angle $\alpha_2$ may be an angle in a range of 5 degrees to 80 degrees, e.g., 10, 15, 20, 30, 45, 60, or 75 degrees. For example, in some embodiments, the first wing angle $\alpha_1$ and the second wing angle $\alpha_2$ may each be 19.5 degrees. The nose 120 is tapered from a central thickness $T_c$ at the central segment 136 to a first end thickness $T_{e1}$ at the first end portion 124 at the first wing angle $\alpha_1$. The nose 120 is tapered from the central thickness $T_c$ to a second end thickness $T_{e2}$ at the second end portion 126 at the second wing angle $\alpha_2$. In embodiments, the first end thickness $T_{e1}$ and the second end thickness $T_{e2}$ are equal. In some embodiments, the first end thickness $T_{e1}$ and the second end thickness $T_{e2}$ are different from each other. The central thickness $T_c$ may be greater than the first end thickness $T_{e1}$ and the second end thickness $T_{e2}$. In particular embodiments, the central thickness $T_c$, the first end thickness $T_{e1}$, and the second end thickness $T_{e2}$ may be equal.

The profile of the bottommost surface 122 of the nose 120 may have a variety of shapes. The profile of the bottommost surface 122 may be dictated by the shape of the workpiece to be joined. For example, the profile of the bottommost surface 122 may be shaped to fit within curves of the workpiece without contacting other portions of the workpiece. As shown in FIG. 4, the bottommost surface 122 may have a substantially trapezoidal profile. The end portions 124, 126 and the central segment 136 may be arcuate such that the corners of the substantially trapezoidal profile are rounded. In such an embodiment, the respective transitions between the first end portion 124, the second end portion 126, the front side 128, the first wing segment 132, the second wing segment 134, and the central segment 136 may be smooth at the bottommost surface 122, e.g., without noticeable corners or vertices. The first wing segment 132 and the second wing segment 134 may have equal lengths. In some embodiments, the first wing segment 132 and the second wing segment 134 may have different lengths.

In some embodiments, the bottommost surface 122 may be triangular with the first wing segment 132, the second wing segment 134, and the front side 128 intersecting at vertices. In such an embodiment, the vertices formed by the intersection of the first wing segment 132, the second wing segment 134, and the front side 128 may form the first end portion 124, the second end portion 126, and the central segment 136. Specifically, the intersection between the front side 128 and the first wing segment 132 may be the first end portion 124, the intersection between the front side 128 and the second wing segment 134 may be the second end portion 126, and the intersection between the first wing segment 132 and the second wing segment 134 may be the central segment 136.

In embodiments, the end portions 124, 126 may be planar such that the end portions 124, 126 are perpendicular to the front side 128. In some embodiments, the central segment 136 may be planar such that the central segment 136 is parallel to the front side 128. In certain embodiments, the end portions 124, 126 and the central segment 136 are planar and such that the bottommost surface 122 has a trapezoidal profile. In such an embodiment, the respective transitions between the first end portion 124, the second end portion 126, the front side 128, the first wing segment 132, the second wing segment 134, and the central segment 136 may be sharp or abrupt, e.g., with corners or vertices. Alternatively, the respective transitions may include a fillet or a chamfer.

To minimize or prevent deformation of the workpiece 220, the head 100 may have a length L large enough to cover or contact three adjacent fastening sites. In general, the spacing between adjacent fasteners may be two to six times that of the diameter of the fastener. As such, the length L of the head 100 may be determined by the size of the fastener being inserted by the fastening system and the spacing between adjacent fasteners. In embodiments, the length L may be twice the diameter of the fastener times a number between two and six. Specifically, the length L of the head 100 at the bottommost surface 122 for a given application may be determined by the equation:

$$L=2(s(d))$$

where L is the length of the head 100 at the bottommost surface 122, d is the diameter of the fastener, e.g., a diameter in a range of 2 mm to 10 mm, and s is a number representing the distance between adjacent fasteners that is greater than or equal to two and less than or equal to six. For example, where d=5 mm and s=4.5 the length L may be 45 mm. In embodiments, the length L may be in the range of 40 mm to 80 mm, e.g., 45, 50, 55, 60, 65, 70, or 75 mm. In particular embodiments, the length L may be 63, 64, 65, 66, 67, 68, or 69 mm.

The length L of the nose 120 may limit the nose 120 from accessing some internal corners of the workpiece 220. For example, near an internal corner, the end portions 124, 126 may engage a wall of the workpiece 220 and prevent the passage 102 of the head 100 from aligning with a fastening site for insertion of fastener. The tapering of the thickness T of the nose 120 may allow the head 100 to access internal corners of the workpiece 220. Specifically, as described above, the thickness T of the nose 120 tapers from the central thickness $T_c$ at the central segment 136 to the first end thickness $T_{e1}$ at the first end portion 124 at the first wing angle $\alpha_1$ and the thickness T of the nose 120 tapers from the central thickness $T_c$ to a second end thickness $T_{e2}$ at the second end portion 126 at the second wing angle $\alpha_2$. The tapering of the nose 120 may provide clearance for the nose 120 to access an internal corner while maintaining a length L that allows for contact of the bottommost surface 122 with adjacent fastening sites.

In embodiments, the head 100 may include a neck 150 between the nose 120 and the connector 110. The neck 150 spaces the nose 120 apart from the connector 110. The neck 150 may allow the nose 120 to access the workpiece 220 that is recessed. The neck 150 may increase the height H of the head 100 without altering other aspects of the head 100. For example, the neck 150 may increase the height H while the length L of the head 100 may remain unchanged.

Figure 5:
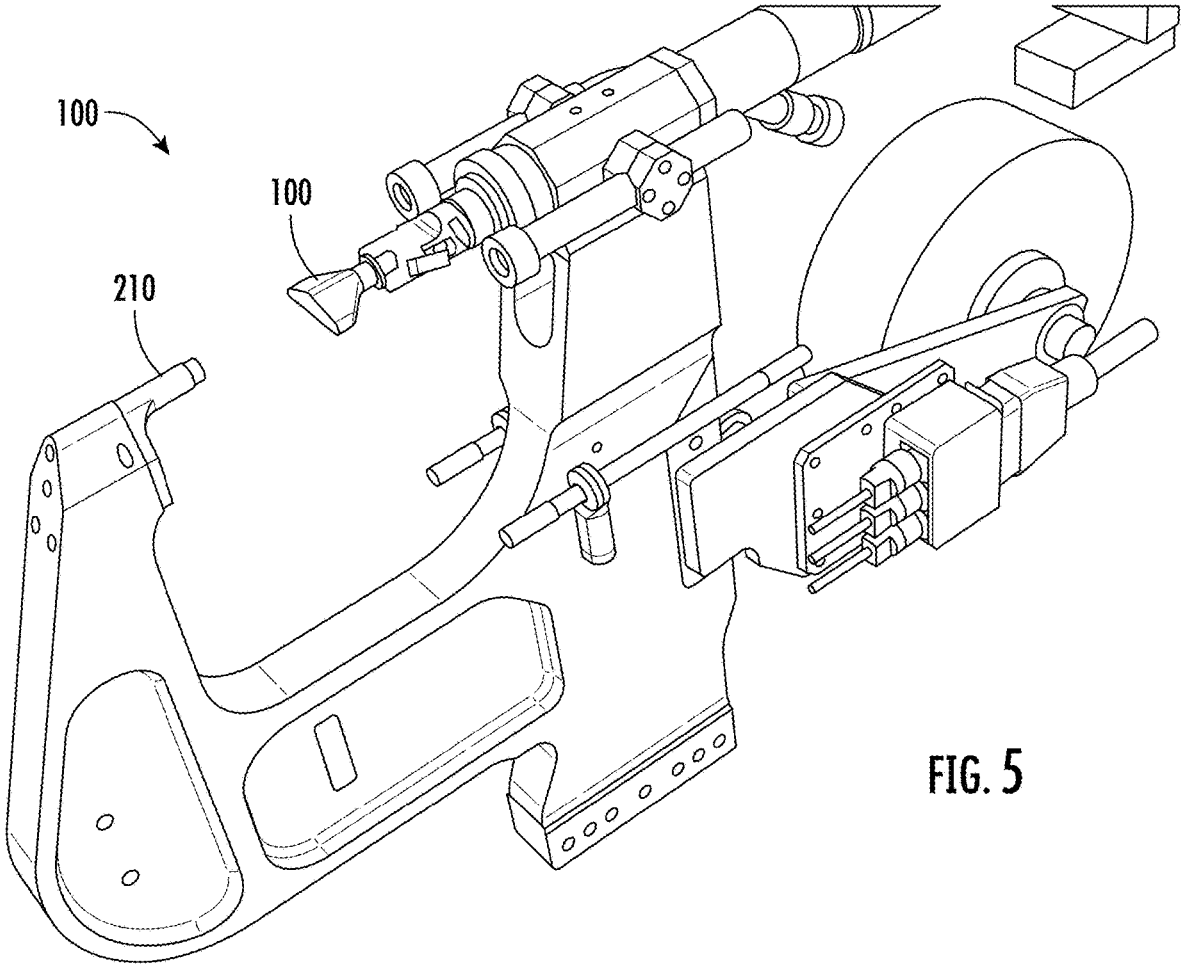
FIG. 5 is a perspective view of a portion fastening system in accordance with embodiments of the present disclosure.

Referring to FIG. 5, an example riveting system 200 in accordance with embodiments of the present disclosure is shown. The riveting system 200 includes the head 100, a die 210, and fastener setting tool 212. The riveting system 200 may advance the head 100 toward the die 210 to clamp the workpiece 220 between the head 100 and the die 210. When the workpiece 220 is clamped, a fastener, e.g., a rivet, may be inserted into the workpiece 220 through the passage 102 of the head 100 by the fastener setting tool 212. The fastener setting tool 212 may include a punch to drive a fastener into the workpiece 220 and into the die 210. The punch may travel through the passage 102 along the drive axis D-D. The die 210 may upset, e.g., deform, the end of a shank of the fastener and secure the fastener in place within the workpiece 220. In embodiments, the riveting system 200 may be an automated riveting system 200 such as a CNC controlled riveting system 200. In such an embodiment, the riveting system 200 may automatically align with fastening sites for insertion of fasteners into the workpiece 220.

Figure 6:
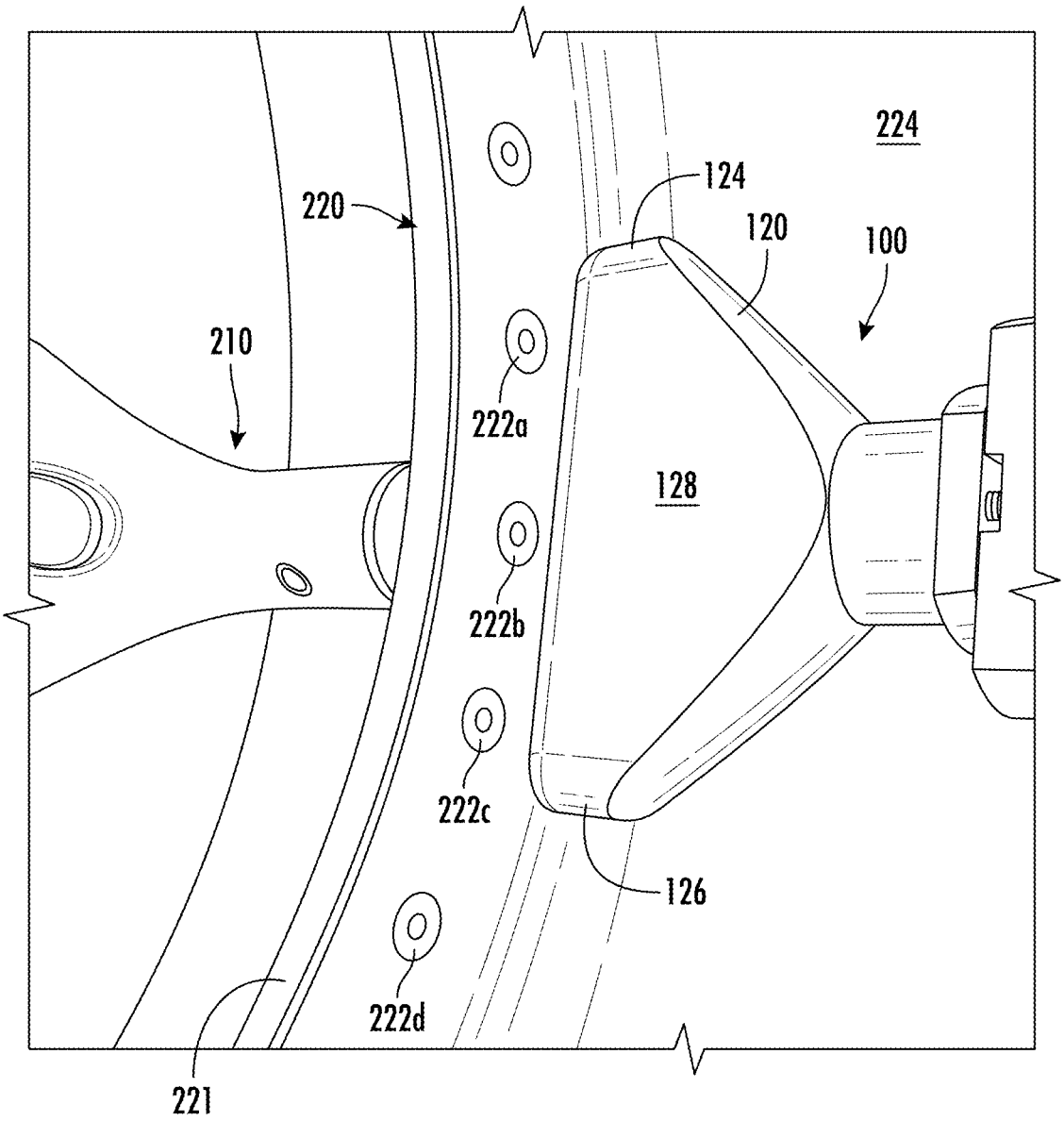
FIG. 6 is a close-up, perspective view of the fastening system of FIG. 5 with a workpiece positioned between a die of the fastening system and the head of FIG. 2 in accordance with embodiments of the present disclosure.

Referring to FIG. 6, a close-up perspective view of the riveting system 200 with the workpiece 220 positioned between the head 100 and the die 210 is shown. Specifically, the workpiece 220 may be a flange of a body of an automobile. For example, the flange may be located along a doorframe of the body and may form a portion of a doorjamb. The flange may extend from a wall 224 of the body. The flange may include two or more layers of sheet metal to be fastened together to form the joint 221. Where the flange forms a portion of a doorjamb, deformation, e.g., pillowing, of the flange may cause interference with a door of the automobile, potentially preventing closure of the door.

The workpiece 220 has a plurality of fastening sites 222. The fastening sites 222 are the locations on the workpiece 220 for insertion of a fastener. When the workpiece 220 is disposed between the head 100 and the die 210, the bottommost surface 122 may contact the workpiece 220 at more than one fastening site 222 when a fastener is being inserted into the workpiece 220. More particularly, the bottommost surface 122 may contact three adjacent fastening sites 222. For example, the bottommost surface 122 may contact the workpiece 220 at a first fastening site 222*a*, a second fastening site 222*b*, and a third fastening site 222*c*. The passage 102 of the head 100 aligns with the second fastening site 222*b* to allow for insertion of the fastener into the workpiece 220 at the second fastening site 222*b*. A fastener may already be inserted in the workpiece 220 at the first fastening site 222*a* or the third fastening site 222*c* when the fastener is inserted into the second fastening site 222*b*. The bottommost surface 122 contacts the first fastening site 222*a* at or adjacent to first end portion 124 and contacts the third fastening site 222*c* at or adjacent to the second end portion 126. The contact between the bottommost surface 122 and the workpiece 220 may distribute force across the contact area to minimize or prevent pillowing of the workpiece 220. Additionally or alternatively, the bottommost surface 122 may contact the workpiece 220 and obstruct deflection of the workpiece 220 to resist deformation. As such, the resulting joint 221 of the workpiece 220 is substantially smooth, without pillowing. In embodiments, the bottommost surface 122 uniformly contacts the workpiece 220 during insertion of the fastener. Uniform contact between the bottommost surface 122 and the workpiece 220 may distribute the insertion forces evenly to minimize deformation. Additionally, as shown in FIG. 6, the joint 221 may extend along an internal corner of the workpiece 220. As described above, the nose 120 does not clash with the wall 224 as a result of the tapering of the nose 120 allowing the nose 120 to access the workpiece 220 within the corner.

Figure 7:
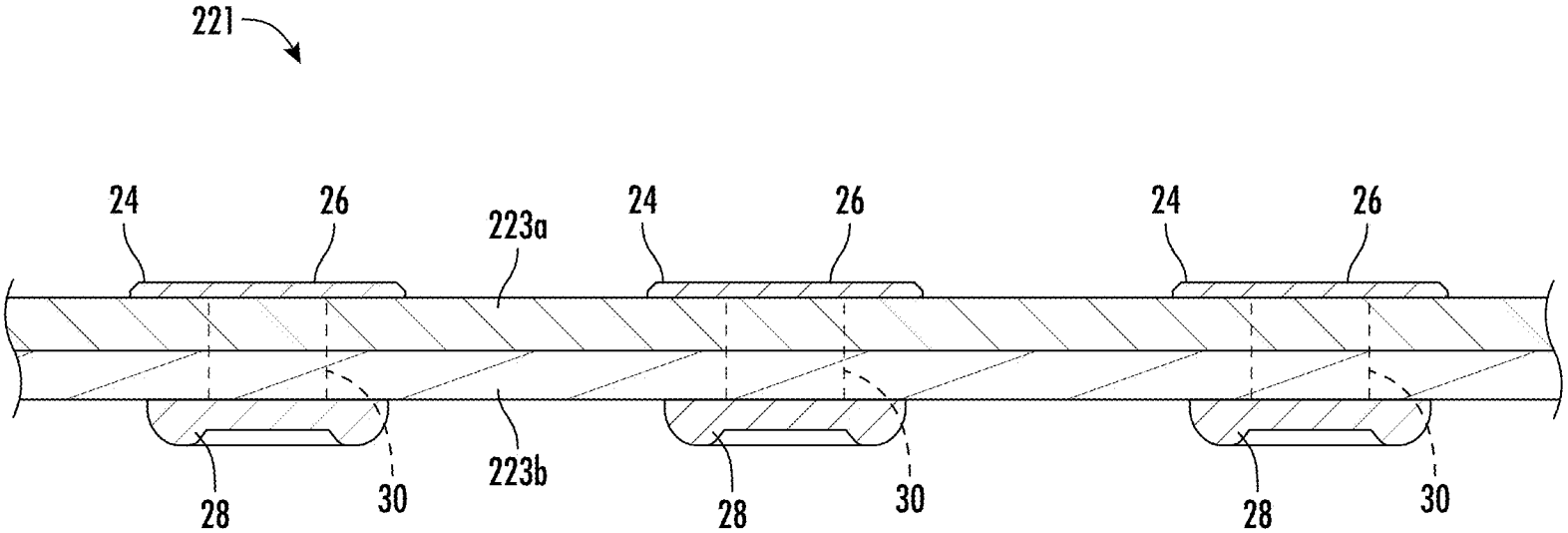
FIG. 7 is an end view of a joint formed by the fastening of FIG. 6.

Referring to FIG. 7, a portion of the joint 221 is shown after insertion of several fasteners 24, e.g., self-piercing rivets, into the workpiece 220. Specifically, the workpiece 220 includes two sheets of material 223*a*, 223*b* fastened together. In embodiments, the workpiece 220 may include more than two sheets of material, e.g., three sheets, four sheets, or more than four sheets. The sheets of material 223*a*, 223*b* are clamped between a head 26 and an upset end 28 of a shank 30 of the fasteners 24. The shank 30 of the fasteners 24 extends through both sheets of material 223*a*, 223*b*. In embodiments, adhesives, sealants, or gaskets may be disposed between the sheets of material 223*a*, 223*b*. The adhesives, sealants, or gaskets may be disposed between the sheets of material 223*a*, 223*b* before the fasteners 24 are inserted into the workpiece 220. In such embodiments, the fasteners 24 may be inserted through the adhesives, sealants, or gaskets and the sheets of material 223*a*, 223*b*.

Figure 8:
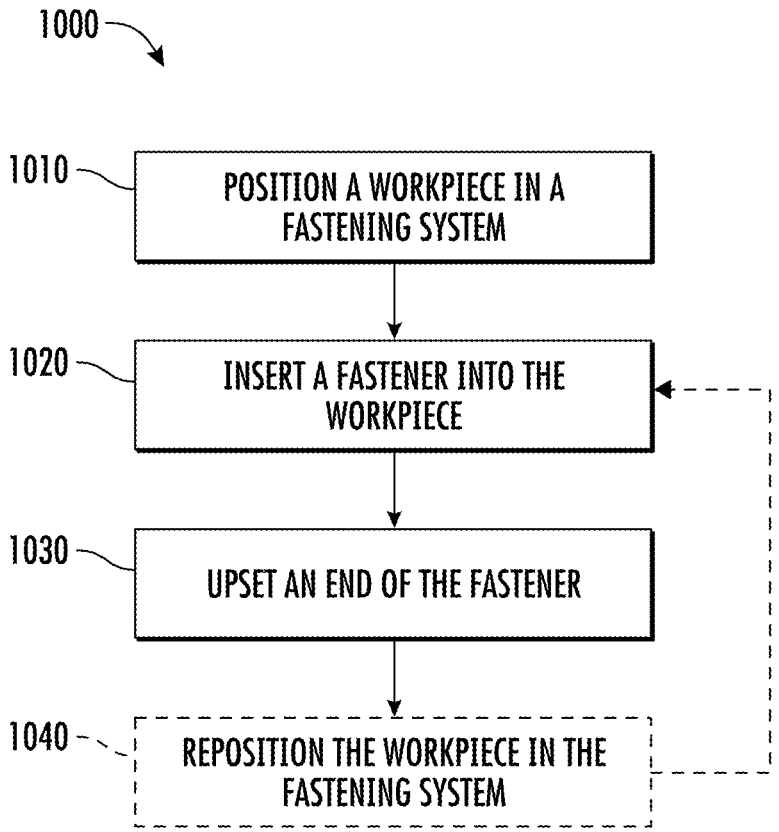
FIG. 8 is a flowchart illustrating a method in accordance with embodiments of the present disclosure.

Referring to FIG. 8, a method 1000 of inserting a fastener into a workpiece in accordance with embodiments of the present disclosure is described with reference to the head 100 of FIGS. 2-4 and the riveting system 200 of FIGS. 5-7.

The workpiece 220 is positioned between the die 210 and the head 100 of the riveting system 200 (Step 1010). The workpiece 220 may be positioned such that the bottommost surface 122 will contact the workpiece 220 at the first fastening site 222*a*, the second fastening site 222*b*, and the third fastening site 222*c* when the workpiece 220 is clamped between the head 100 and the die 210. The passage 102 of the head 100 aligns with the second fastening site 222*b* to allow for insertion of the fastener into the workpiece 220 through the passage 102. The bottommost surface 122 contacts the first fastening site 222*a* at or adjacent to first end portion 124 and contacts the third fastening site 222*c* at or adjacent to the second end portion 126. The contact between the bottommost surface 122 and the workpiece 220 may distribute force across the contact area and minimize or prevent pillowing of the workpiece 220 when the fastener is inserted into the workpiece 220 and is upset by the die 210. The workpiece 220 may be positioned such that the bottommost surface 122 uniformly contacts the workpiece 220 across the length L between the end portions 124, 126.

A fastener is inserted into the workpiece 220 (Step 1020). The fastener is inserted into the workpiece 220 at the second fastening site 222*b*. In embodiments, a punch of the riveting system 200 may force a fastener through the workpiece 220 at the second fastening site 222*b*. For example, the fastener may be a self-piercing rivet that forms a hole in the workpiece 220 when inserted into the workpiece 220. In some embodiments, a drilling process may form a hole at the fastening sites 222 prior to insertion of the fastener.

An end 28 of a shank 30 of the fastener 24 is upset, e.g., deformed, to secure the fastener within the workpiece 220 (Step 1030). When the fastener is inserted into the workpiece 220, the fastener strikes the die 210 to upset an end of the fastener. Upsetting the fastener prevents withdrawal of the fastener from the workpiece 220 and joins the pieces, e.g., the sheets 223*a*, 223*b*, of the workpiece 220 together. However, upsetting the end 28 of the fastener may be the cause of pillowing in the workpiece 220. Specifically, upsetting the end 28 may cause the shank 30 to expand radially, and the radial expansion of the shank 30 may result in the material of the workpiece 220 pillowing. When the workpiece 220 and the bottommost surface 122 are in contact during upsetting of the end 28, the head 100 may reduce or eliminate pillowing of the workpiece 220 as a result of distributing forces across the bottommost surface 122 as described above. Upsetting the fastener may occur concurrently with insertion of the fastener into the workpiece 220. For example, the die 210 may begin to upset the end 28 before the fastener 24 is fully inserted into the workpiece 220.

The workpiece 220 may be repositioned to insert another fastener (Step 1040). Once a fastener is secured at the second fastening site 222*b*, the workpiece 220 may be repositioned such that the passage 102 aligns with the third fastening site 222*c*. The workpiece 220 may be clamped between the head 100 and the die 210 such that the bottommost surface 122 contacts the workpiece 220 at the second fastening site 222*b* and a fourth fastening site 222*d* with the third fastening site 222*c* located between the second fastening site 222*b* and the fourth fastening site 222*d*. The workpiece 220 may be repositioned manually or may be repositioned automatically.

Although the method steps are described in a specific order, it should be understood that other steps may be performed in between described steps, described steps may be adjusted so that they occur at slightly different times, or the described steps may occur in any order unless otherwise specified.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A method of inserting fasteners into a workpiece including at least two sheets of material, the method comprising:

fastening the at least two sheets of material of the workpiece at a first fastening site thereof with a first fastener;

positioning the workpiece with the at least two sheets of material between a die and a head of a fastening system, the workpiece having a second fastening site and a third fastening site, the second fastening site between the first fastening site and the third fastening site, a passage of the head aligned with the second fastening site of the workpiece, a bottommost surface of the head in contact with the workpiece from the first fastening site to the third fastening site;

inserting a second fastener into the workpiece through the passage of the head at the second fastening site and through the at least two sheets of material; and upsetting an end of a shank of the second fastener with the die to fasten the at least two sheets of material together.

2. The method according to claim 1, wherein positioning the workpiece with the bottommost surface in contact with the workpiece at the first fastening site and the third fastening site is configured to prevent pillowing of the workpiece between the first fastening site and the second fastening site and between the second fastening site and the third fastening site when the end of the shank of the second fastener is upset with the die.

3. The method according to claim 1, wherein positioning the workpiece includes advancing the head toward the die to clamp the workpiece between the die and the head such that the bottommost surface is in contact with the workpiece.

4. The method according to claim 1, wherein inserting the second fastener and upsetting the end of the shank of the second fastener occur concurrently.

5. The method according to claim 1, wherein inserting the second fastener into the workpiece includes striking the second fastener with a punch of the fastening system.

6. The method according to claim 1, further comprising repositioning the workpiece between the die and the head with the third fastening site aligned with the passage of the head, the bottommost surface in contact with the workpiece from the second fastening site to a fourth fastening site, the third fastening site positioned between the second fastening site and the fourth fastening site.

7. The method according to claim 6, wherein repositioning the workpiece includes automatically aligning the passage with the third fastening site.

8. A method of forming a rivet joint to form a body panel of an automobile, the method comprising:

positioning a flange of the body panel between a die and a head of a fastening system, the flange having a first fastening site, a second fastening site, and a third fastening site, the second fastening site between the first fastening site and the third fastening site, a passage of the head aligned with the second fastening site of the flange, a bottommost surface of the head in contact with the flange from the first fastening site to the third fastening site, the first fastening site, the second fastening site, and the third fastening site spaced apart from the adjacent fastening site a distance in a range of two times a diameter of a rivet to six times the diameter of the rivet;

inserting the rivet into the flange through the passage of the head at the second fastening site;

upsetting an end of a shank of the rivet with the die; and repositioning the flange between the die and the head with the third fastening site aligned with the passage of the head, the bottommost surface in contact with the flange from the second fastening site to a fourth fastening site, the third fastening site positioned between the second fastening site and the fourth fastening site.

9. The method according to claim 8, wherein positioning the flange with the bottommost surface in contact with the flange at the first fastening site and the third fastening site is configured to prevent pillowing of the flange between the first fastening site and the second fastening site and between the second fastening site and the third fastening site when the end of the shank of the rivet is upset with the die.

10. The method according to claim 8, wherein positioning the flange includes advancing the head toward the die to clamp the flange between the die and the head such that the bottommost surface is in contact with the flange.

11. The method according to claim 8, wherein positioning the flange includes uniformly contacting the bottommost surface with the flange between the first fastening site and the third fastening site.

12. A method of inserting a fastener having a diameter into a workpiece including at least two sheets of material, the method comprising:

positioning the workpiece with the at least two sheets of material between a die and a head of a fastening system, the workpiece having a first fastening site, a second fastening site, and a third fastening site, the second fastening site between the first fastening site and the third fastening site, a passage of the head aligned with the second fastening site of the workpiece, a bottommost surface of the head in contact with the workpiece and covering the first fastening site, the second fastening site, and the third fastening site;

inserting the fastener into the workpiece through the passage of the head at the second fastening site and through the at least two sheets of material;

upsetting an end of a shank of the fastener with the die to fasten the at least two sheets of material together; and repositioning the workpiece between the die and the head with the third fastening site aligned with the passage of the head, the bottommost surface in contact with the workpiece and covering the second fastening site, the third fastening site, and a fourth fastening site, the third fastening site positioned between the second fastening site and the fourth fastening site.

13. The method according to claim 12, wherein covering the first fastening site, the second fastening site, and the third fastening site with the bottommost surface of the head includes each of the first fastening site, the second fastening site, and the third fastening site being spaced apart from the adjacent fastening site a distance in a range of two times a diameter of the fastener to six times the diameter of the fastener.

* * * * *